US010399739B2

(12) United States Patent
Lenz et al.

(10) Patent No.: US 10,399,739 B2
(45) Date of Patent: Sep. 3, 2019

(54) PLASTIC PALLET WITH STIFFENING STRUCTURE

(71) Applicants: Cabka Group GmbH, Berlin (DE); GreenCycle GmbH, Neckarsulm (DE)

(72) Inventors: Thorsten Lenz, Berlin (DE); Stefan Mueller, Gera (DE); Gat Ramon, Berlin (DE); René Kloeters, Bad Friedrichshall (DE); Thomas Tappertzhofen, Neckarsulm (DE)

(73) Assignees: Cabka Group GmbH, Berlin (DE); GreenCycle Umweltmanagement GmbH, Neckarsulm (DE)

( * ) Notice: Subject to any disclaimer, the term of this patent is extended or adjusted under 35 U.S.C. 154(b) by 0 days.

(21) Appl. No.: 15/968,610

(22) Filed: May 1, 2018

(65) Prior Publication Data

US 2018/0339802 A1 Nov. 29, 2018

(30) Foreign Application Priority Data

May 2, 2017 (EP) ..... 17 169 002

(51) Int. Cl.
*B65D 19/00* (2006.01)
*B65D 6/34* (2006.01)

(52) U.S. Cl.
CPC ..... *B65D 19/0012* (2013.01); *B65D 11/26* (2013.01); *B65D 19/0026* (2013.01);
(Continued)

(58) Field of Classification Search
CPC ..... B65D 2519/00034; B65D 2519/00139; B65D 2519/00422; B65D 2519/00412;
(Continued)

(56) References Cited

U.S. PATENT DOCUMENTS 2,823,883 A * 2/1958 Bourdon ..... B65D 19/0095 108/57.1
3,675,596 A * 7/1972 Colas ..... B65D 19/0012 108/51.11

(Continued)

FOREIGN PATENT DOCUMENTS

DE 71 33 741 U 5/1972
DE 43 36 469 A1 5/1994

(Continued)

*Primary Examiner* — Jose V Chen

(74) *Attorney, Agent, or Firm* — Christensen, Fonder, Dardi & Herbert PLLC

(57) ABSTRACT

A plastic pallet comprising a deck for storing objects to be transported, feet which are formed protruding from a deck underside, and runners which are formed in each case connecting at least two feet to each other on their undersides. The plastic pallet also comprises at least one stiffening structure which comprises lower side rails arranged in the runners, and upper side rails arranged spaced apart therefrom, which are arranged above the lower side rails running parallel thereto. The stiffening structure comprises rungs, each with a predominantly closed surface, which connect the lower side rails in the feet to the upper side rails. The rungs are formed in one piece on the side rails or are connected thereto in each case via contact surfaces in bonded, friction-locking or form-locking manner. As such, the pallet bending stiffness and shear strength in a plane parallel to the deck upper side are increased.

15 Claims, 9 Drawing Sheets

(52) U.S. Cl.
CPC ..... *B65D 2519/00034* (2013.01); *B65D 2519/00069* (2013.01); *B65D 2519/00104* (2013.01); *B65D 2519/00129* (2013.01); *B65D 2519/00139* (2013.01); *B65D 2519/00273* (2013.01); *B65D 2519/00288* (2013.01); *B65D 2519/00293* (2013.01); *B65D 2519/00308* (2013.01); *B65D 2519/00323* (2013.01); *B65D 2519/00333* (2013.01); *B65D 2519/00373* (2013.01); *B65D 2519/00407* (2013.01); *B65D 2519/00432* (2013.01); *B65D 2519/00437* (2013.01); *B65D 2519/00442* (2013.01); *B65D 2519/00447* (2013.01); *B65D 2519/00467* (2013.01); *B65D 2519/00562* (2013.01); *B65D 2519/00567* (2013.01); *B65D 2519/00796* (2013.01)

(58) Field of Classification Search
CPC ..... B65D 2519/00407; B65D 2519/00437; B65D 2519/00467
USPC ..... 108/57.25, 51.11, 57.26, 57.27
See application file for complete search history.

(56) References Cited

U.S. PATENT DOCUMENTS 3,880,092 A * 4/1975 Seeber ..... B65D 19/0016 108/57.28
4,292,899 A * 10/1981 Steffen ..... B65D 19/0095 108/51.11
4,715,294 A * 12/1987 Depew ..... B65D 19/0095 108/57.1
4,735,154 A * 4/1988 Hemery ..... B65D 19/0012 108/56.1
4,869,179 A * 9/1989 Sammons ..... B65D 19/0073 108/56.1
5,402,735 A * 4/1995 DeJean ..... B65D 19/0081 108/56.1
5,413,052 A * 5/1995 Breezer ..... B65D 19/0012 108/56.1
5,673,629 A * 10/1997 Ginnow ..... B65D 19/0095 108/56.1
5,809,902 A * 9/1998 Zetterberg ..... B65D 19/0069 108/51.11
5,868,080 A * 2/1999 Wyler ..... B65D 19/0022 108/57.25
8,196,527 B2 * 6/2012 Linares ..... B65D 19/0038 108/51.3
8,424,468 B2 * 4/2013 Aden ..... B65D 19/0026 108/56.3
8,448,582 B2 5/2013 Jian
8,671,848 B2 * 3/2014 Randall ..... B65D 19/0095 108/51.11
8,770,115 B2 * 7/2014 Apps ..... B65D 19/0004 108/57.25
9,038,547 B2 * 5/2015 Whiteford ..... B65D 19/0095 108/57.25
9,139,334 B2 * 9/2015 Wahl ..... B65D 19/0016
2006/0201399 A1 * 9/2006 Swistak ..... B65D 19/0059 108/57.25
2006/0201402 A1 * 9/2006 Moore, Jr. ..... B65D 19/0012 108/57.25
2007/0204768 A1 * 9/2007 Li ..... B29C 45/1634 108/57.25
2007/0245932 A1 * 10/2007 Nielsen ..... B65D 19/0093 108/51.11
2008/0202391 A1 * 8/2008 Pisano ..... B65D 19/0044 108/57.25
2009/0000524 A1 * 1/2009 Nordstrom ..... B65D 19/0095 108/53.5
2010/0154685 A1 6/2010 Arinstein
2011/0120353 A1 * 5/2011 Jensen ..... B65D 19/0016 108/57.25
2011/0259249 A1 * 10/2011 Ogburn ..... B65D 19/0038 108/57.33
2011/0303128 A1 12/2011 Linares
2013/0136573 A1 * 5/2013 Berry ..... B65D 19/0038 414/800
2018/0322453 A1 * 11/2018 Lantz ..... G06Q 10/0833

FOREIGN PATENT DOCUMENTS

DE 20 2007 000 985 U1 7/2008
DE 10 2011 052 958 A1 11/2012
DE 10 2011 103 359 A1 11/2012
DE 20 2015 100 355 U1 4/2015
DE 10 2014 007 079 A1 11/2015
GB 2 272 203 A 5/1994
GB 2 434 141 A 7/2007
JP S50-30467 U 4/1975
JP S53-27562 U 3/1978
JP S56-123248 U 9/1981
WO WO 2007/019833 A1 2/2007
WO WO 2012/163793 A1 12/2012

* cited by examiner

PLASTIC PALLET WITH STIFFENING STRUCTURE

PRIORITY CLAIM

The present application claims priority to European Patent Application No. 17169002.7, filed on May 2, 2017, which said application is incorporated by reference in its entirety herein.

FIELD OF THE INVENTION

The invention relates to a plastic pallet which firstly comprises a deck for storing objects to be transported, as well as feet which are formed protruding from a deck underside. In addition, the plastic pallet comprises runners which are formed in each case connecting at least two feet to each other on their undersides, i.e. on the side opposite the deck. Finally, the plastic pallet also comprises at least one stiffening structure which, for its part, comprises lower side rails arranged in the runners and upper side rails lying precisely above the lower side rails, arranged spaced apart from, and running parallel to, the latter. The upper side rails can be arranged in the deck in the area between a deck upper side and the deck underside, or also below the deck underside.

BACKGROUND OF THE INVENTION

In addition to the conventional wooden pallets, plastic pallets are today playing an ever-increasing role in the transport and storage of goods. For example the lower weight and the possibility of forming almost any desired pallet structure using injection-moulding techniques are advantageous, with the result that a high degree of individuality can be achieved here, and it is possible in particular to respond to customer-specific requests. In addition, unless particular hygiene regulations are to be complied with, recycled material can be used for producing many pallet types. The use of additives such as for example reinforcing fibers is also possible. The deck can comprise a continuous, closed load platform, however the load platform can also be formed by a grid or rib structure.

On the underside of the deck, i.e. facing the ground, feet are formed protruding downwards. They have a height which makes it possible for the pallet to be picked up with the fork of a forklift truck and transported; the fork enters into the spaces between the feet. At the same time, however, the feet must also be capable of bearing the permissible weight of the pallet with goods stored thereon, without this resulting in signs of fatigue of the material. Although it is possible to produce the feet separately from a material with a higher impact strength, this type of production is more expensive in comparison with one-piece production of a pallet, as more tools have to be kept ready and the pallet then has to be assembled.

For transport on roller and chain conveyors on the one hand, and for increasing stability on the other hand, plastic pallets often also comprise runners which are formed in each case connecting at least two feet to each other on their undersides. The runners are mostly arranged parallel to each other; in the case of rectangular pallets their longitudinal direction usually lies parallel to the narrower edge of the pallet, though not necessarily: a connection of the feet along the longer edge is also possible. Circumferential runners can also be used, i.e. runners which in addition also connect the feet to each other along the longer edge of the pallet.

However, plastic pallets also have disadvantages compared with wooden or metal pallets. One disadvantage is that, under load, plastic pallets tend towards greater deformations than wooden pallets. At worst, this can lead to irreversible deformations. If goods with a high, though still permissible, mass are placed on the pallets, this leads to a deflection of the deck, wherein the feet with runners formed thereon are also slightly deformed, or bear their share of the deflection, in that the feet are inclined inwards at the top, in the direction of the deck center; however they move outwards at the bottom. Thrust, bending and shear forces thus occur, which can only insufficiently reversibly be reabsorbed by the pallet.

In order to reduce the deformation under load, it is known in the state of the art to reinforce plastic pallets with stiffening structures in order to increase in particular the bending stiffness of the pallets.

For example, DE 20 2015 100 355 U1 describes a plastic pallet that can be assembled from several parts, into the deck of which metal rods are inserted in longitudinal direction to increase the bending stiffness. The metal rods are here arranged transverse to the longitudinal direction of the runners. They reinforce the deck structure and lie parallel to each other, without being interconnected.

DE 10 2014 007 079 A1 describes a two-part plastic pallet with reinforcing profiles which have the function of stiffening elements. The stiffening elements are rod-like and are slid separately into the runners. Here the runner structure is reinforced in the area of the ground level.

In DE 10 2011 103 359 A1, FIG. 8 shows a plastic pallet in which reinforcing elements are arranged in the corners. Apart from the reinforcing elements that are not interconnected, which are also referred to as fittings, the pallet is manufactured in one piece. In the finished pallet the reinforcing elements extend from the deck to the ground and are not interconnected. Fitting the reinforcing elements exclusively in the corners serves to increase the wear resistance.

DE 10 2011 052958 A1 describes a pallet assembled from several parts, in which foot elements are formed arched and arranged crosswise. On their side facing the deck, in the area of the apex of the arches, supporting rods which can also be manufactured from metal are inserted, extending over the length of the foot elements. The bearing capacity of the pallet is increased by the grid arrangement. DE 43 36 469 A1 also describes a plastic pallet in which the deck structure is reinforced with a framework of reinforcing tubes which can for example be manufactured from steel.

DE 20 2007 000 985 U1 describes a plastic pallet which is provided with reinforcements both in the area below the deck and in the area of the feet just above the ground. According to the embodiment shown in FIGS. 1-3, the reinforcement elements which can be formed from a rod- or bar-shaped material form a grid structure in the deck, and along the narrow side of the pallet two reinforcement elements arranged one above the other lie parallel to each other, wherein one element is below the surface of the deck, embedded therein, and the other in the underside of the runner. However, the reinforcement elements are not in direct contact with each other; they are not interconnected.

WO 2007/019833 A1 describes a plastic pallet in which reinforcing elements are arranged below the base plate of the pallet in the area of the feet and within the deck. Here FIGS. 9-11 show a pallet consisting of a deck and feet attached thereto, wherein in each case three of the feet are connected in the runners along the longer side of the pallet by foot rails which can consist of steel sheet. In the deck, reinforcing elements likewise manufactured from steel sheet are arranged in the manner of a grid; the intersections of the longitudinal braces and cross braces lie in the area of the feet. There, the grid structure is connected to the foot rails via stays, wherein no more detailed statement is made about the type of connection. Polystyrene is named as preferred material for the pallet described in WO 2007/019833 A1 and the grid structure serves to increase the dimensional stability. The longitudinal and cross braces arranged in the deck as well as the stays in the feet comprise a plurality of aligned recesses, which are intended to guarantee that they can be completely penetrated by the plastic of the pallet; in this way the connection to the plastic can be improved and the stability of the overall construction can be increased compared with that of a simple polystyrene pallet. In addition, the high number of recesses ensures that the weight of the pallet does not increase excessively compared with that of a pure polystyrene pallet.

Although such a structure of stiffening elements with recesses is very advantageous with respect to the weight and the connection to the plastic, and increases the stability with respect to direct loading from above, there is scarcely any increase in loading due to shear forces. In addition, the connection of the longitudinal or cross braces to the foot rails via the stays occurs only through the bond in the plastic, with the result that the pallet can withstand only low bending and shear forces.

SUMMARY OF THE INVENTION

The object of the invention is therefore to develop a pallet which, compared with the pallets known in the state of the art, has an increased resistance to bending and shear forces and consequently less deflection.

In the case of a plastic pallet of the type described at the outset, this object is achieved in that the at least one stiffening structure comprises rungs, in each case with a predominantly closed surface, which connect the lower side rails in the feet to the upper side rails. The rungs are formed in one piece on the side rails or preferably bonded thereto in each case via contact surfaces, or also connected in friction-locking or form-locking manner, wherein the types of connection can also be combined, and wherein both types of rungs can definitely be realized on a stiffening structure. Through these measures the bending stiffness of the pallet on the one hand and the shear strength of the pallet in a plane parallel to the upper side of the deck on the other hand are increased vis-à-vis pallets known in the state of the art. In the case of a predominantly closed surface, the proportion of openings in the rungs is less than 50%, mostly less than 25%. Recesses and openings are found only where this is necessary or advantageous for reasons of manufacturing technology. In fact the proportion of openings is therefore less than 10% of the surface as a rule.

The at least one stiffening structure is thus formed as a ladder-like structure with side rails and rungs, wherein the side rails are connected to the rungs and firmly and preferably inseparably interconnected, with the result that the ladder-like structure is capable of absorbing correspondingly high shear forces. The firm and preferably inseparable connection which is necessarily present in the case of one-piece formation of the rungs and the side rails and, in the case of designs in which the rungs are not formed on side rails, is preferably achieved by an extensive adhesive bond, for example by gluing, but particularly preferably by welding, is only a partial aspect. To increase the bending stiffness or shear strength it is equally essential that the rungs have a predominantly closed surface, in the case of plate-shaped rungs for example, this means that in the plate-shaped rung parts, as few openings or recesses as necessary are formed, which however in any case occupy less than 50% of the overall surface of the plate-shaped rung part, as a plurality of such recesses reduce the shear strength. If possible, such openings should be dispensed with. As a rule, the plate-shaped rung parts therefore comprise either no openings, or only one, two or three openings through which, for example, optional cross braces can be pushed to form a grid structure. Should no cross braces be used, the ladder-like stiffening structures therefore preferably comprise no openings.

There are various possibilities for connecting the stiffening structures to the pallet or inserting them therein. They can for example already be inserted into the mould, for example an injection mould, during production, with the result that the stiffening structure is almost completely enclosed by the hardened plastic. In this way a particularly firm fit can be guaranteed. In order to be able to exchange the stiffening structures in the event of wear, they can also be pushed into the pallet or the feet of a one-part pallet from below or above. The connection to the plastic of the pallet can then also be effected in friction- and/or form-locking manner. However, the pallet is preferably designed in several parts, and the stiffening structures—optionally connected via cross braces—are inserted into the runners before the deck is placed on the runners and connected thereto, for example via snap locks or in friction-locking, form-locking or bonded manner.

In a simple embodiment, the stiffening structure can for example be manufactured in one piece from strip steel, wherein the spaces between the rungs are punched out, milled or introduced into the stiffening structure in another manner that is suitable in terms of processing technology. The thicker the strip selected, the more the shear strength is also increased. At the same time, however, the mass of the plastic pallet is also increased and if the ladder-like stiffening structure is made of metal, in particular of steel—as is preferably the case—this can lead to the mass of the plastic pallet with stiffening structures becoming higher than the mass of a comparable wooden pallet, with the result that a substantial advantage of the plastic material is lost. On the other hand, too thin a sheet as ladder-like stiffening structure cannot produce the required shear strength. Instead of being made of metal, the ladder-like stiffening structure can also be produced from other materials which can provide the necessary bending and shear stiffness of the pallet. For example, glass-fiber- or carbon-fiber-reinforced plastics are also possible.

However, it has become clear that a sufficiently high shear strength can be produced if in particular the side rails have a corresponding thickness, whereas the rungs can be designed with a smaller thickness. In a preferred embodiment, the side rails therefore have a predetermined thickness, which can be established for example with reference to the required shear strength. By the thickness of the side rails is meant the extent of the side rails perpendicular to their longitudinal direction and perpendicular to the longitudinal direction of the rungs in the ladder-like structure. By designing only the side rails thicker, significant savings can be made in terms of material and thus weight, without resulting in loss of shear strength.

If the rungs are designed in one piece on the side rails, side rails and rungs merge; the rungs can therefore be produced thinner. If the rungs are connected to the side rails via contact surfaces in bonded, friction-locking and/or form-locking manner, the contact surfaces are selected as large as possible in their extent, namely both in height—i.e. in the longitudinal direction of the side rails—and perpendicular thereto, wherein curved surfaces are also possible, basically perpendicular to the height.

In order to guarantee a high degree of stability with respect to bending and shear strength, the rungs have a predetermined height in the longitudinal direction of the side rails—the width in the view in the case of lying ladder-like stiffening structures—which corresponds to at least 80% of the width of the respective foot receiving the rung. For the sake of clarity, the term "height" relates to a standing ladder-like structure; in the case of lying ladder-like structures, this corresponds to the width in the view. The height of the rungs is preferably selected such that the maximum available installation space in the respective foot—which can be different for different feet on the same pallet—is utilized, i.e. in the case of a bonded, friction-locking or form-locking connection, the extent of the contact surfaces in the longitudinal direction of the side rails preferably corresponds to the predetermined height.

The side rails need not be made of solid material over the entire thickness; the side rails can also be formed as hollow structures with different cross-sections. Particularly advantageously, the hollow structure is assembled from various surfaces, wherein in each case at least one of the surfaces of a side rail is aligned parallel to the deck upper side—i.e. perpendicular to the longitudinal direction of the side rails and the rungs, which also contributes to the increase in stability. In the case of the use of hollow structures, the side rails are for example formed as tubes with the cross-section of a quadrilateral, for example a trapezium, rectangle or square, and then correspondingly comprise four surfaces. Alternatively they can also be formed as T-beams or as double T-beams; here too at least one surface—that of the crossbeam of the "T"—lies parallel to the deck upper side.

In this way it is possible to achieve a high degree of stability of the stiffening structure with respect to bending and shearing in the pallet, perpendicular to the direction of the runners, i.e. perpendicular to a plane in which the ladder-like structure lies.

If the rungs are connected via contact surfaces in bonded manner to the side rails formed as tubes with a quadrilateral cross-section, these contact surfaces preferably lie parallel to the deck surface and the extent of the contact surface in the direction of the thickness of the side rails is at least one-quarter of the thickness, but preferably at least half the thickness. Particularly preferably, the extent of the contact surface in the direction of the thickness however corresponds to the entire thickness; this guarantees the best possible stability of the bonded and extensive connection.

The contact surfaces can, however, also lie perpendicular to the deck surface in the plane spanned by rungs and side rails; in the case of tubes with a rectangular cross-section, for example, small plates can then be welded to the side rails, without the plates having to be bent. Depending on the shape of the side rails, the contact surfaces can also have any other shape, or protrude at a different angle; it is important that the contact surfaces are selected so large that they guarantee a secure connection of rungs and side rails up to a predetermined maximum shear and bending load.

This also applies in the case of a friction-locking or form-locking connection. The latter can for example be designed as a snap lock wherein the contact surfaces, in the case of rungs and side rails, then correspond to the surfaces of the lock which lie next to each other in the connected state. A correspondingly stable connection can, for example, be achieved if the snap lock is aligned along the longitudinal direction of the side rails and extends over the predetermined height.

In order to produce a sufficiently stable friction-locking connection, the rungs can, for example, be formed wedge-shaped on their sides facing the side rails—here too preferably over the entire height—and the side rails can comprise corresponding receptacles.

The ladder-like stiffening structure can be realized in a different way; particularly advantageous embodiments are described below.

In a particularly preferred design, particularly suitable for very high quantities, the stiffening structure is formed as an extruded aluminium profile. In this case, the rungs are formed in one piece on the side rails. Between the rungs, openings are made, for example by punching or milling, through which the forks of a forklift truck can enter. Aluminium has the advantage that it is a light metal; in addition no protection against corrosion is necessary.

In a further preferred embodiment which is suitable in particular for smaller and medium quantities of less than 10,000, the stiffening structure is formed in one piece as a tube with a square cross-section, which is bent into the shape of two side rails with rungs lying in between. In this way it is possible to design a stiffening structure with a maximum of three rungs which are formed in one piece on the side rails. Such a stiffening structure can be realized in different ways which differ from each other especially with respect to where the two tube ends are arranged in the stiffening structure. For example, through seven-fold bending, in each case by 90°, it is possible to produce an "8"-shaped structure. In a preferred embodiment which requires only six bends, the two ends of the tube are bent from one of the side rails to the other, opposite side rail and form the middle rung. The tube ends are connected to each other and to the other, opposite side rail in bonded manner. The connection is particularly preferably effected over the entire thickness of the side rail. This type of production makes it possible to provide the tube ends with a further bend to increase the stability, with the result that the effective height of the rung, corresponding to the width in the case of a lying ladder-like structure, grows. This increases the stability with respect to bending and shear strength, when forces act in the area of the middle foot. The bonded connection is particularly preferably produced by welding; the welding points are then protected against corrosion, for example by galvanizing. This profile is in principle relatively inexpensive to produce, as tubes with a square cross-section, for example with a cross-section of 20×20 mm and a wall thickness of 2 mm, are available in large quantities on the market. When profiles are produced, approximately a quarter of the costs arise through sawing the square tubes in order to cut them to length. Through the use of a single, bent tube these costs can be minimized.

In another embodiment which is somewhat expensive in production and more expensive because of the more time-consuming manufacture, the side rails are also formed as tubes with a square cross-section, however at least the inner rungs are formed as plate-shaped connection elements, in the case of which contact surfaces are formed as standing seams on two opposite sides. These are one-piece elements which are also commercially available as so-called C-profiles with a wall thickness of 2 mm for example; alternatively, production by cutting and bending from a flat sheet is also possible. Steel sheet is in particular possible as material, but all other metals and metal alloys which fulfil the requirements can also be used.

By a standing seam is meant a bending-up of the edge of the plate-shaped connection element by 90°. The bent-up surface of the plate-shaped connection element then forms the contact surface. The extent of the contact surface in the direction of the thickness of the side rail is at least one-quarter of the thickness. In the case of a tube diameter of the square tube of approximately 2 cm, the bending edge then lies at a distance of at least 5 mm from the edge of the plate-shaped connection element. However, for a stable connection it is advantageous to make the contact surface as large as possible, with the result that the bending edge lies at a distance of at least half, i.e. 10 mm, at best even the thickness of the tube corresponding to 20 mm from the edge of the plate-shaped connection element, parallel thereto.

A particularly stable, however also production-intensive variant is obtained if all of the rungs are designed as such plate-shaped connection elements, including the outer rungs. At the contact surfaces the plate-shaped connection elements are welded to the tubes, then the welding points have to be galvanized. Depending on the choice of material, it can also be necessary to galvanize the entire stiffening structure.

A somewhat less production-intensive variant, in which the high degree of stability with respect to bending and shear strength in the case of a stiffening structure with three rungs is retained for the middle rung—on which experience shows that the greatest forces act—consists of designing the middle, inner rung as a plate-shaped connection element with contact surfaces formed as standing seams, as described above, but bending the two outer rungs from a tube with a rectangular or square cross-section. The two side rails and the two outer rungs are in this case formed in one piece from a bent tube.

Further possibilities for keeping the material consumption as low as possible in the case of a high degree of stability with respect to bending and shearing consist of using thinner sheets instead of thick sheets or thick stiffening structures, in which case the side rails are formed by bending along the longitudinal direction of the side rails. In this way, seams can be formed on the side rails. The introduction of beading as a special form of the bending is also possible as a reshaping likewise serving for the stiffening; beading can be introduced into the side rails at any point in the longitudinal direction thereof. In this case the stiffening structure is formed as a rolled and/or bent metal profile, with openings made between the rungs which are formed in one piece on the side rails. The bending is effected in the longitudinal direction of the side rails. Sheets of different thickness can be used here, depending on the required load-bearing capacity, for example sheets with thicknesses of from 1 mm to 4 mm. The stability of the stiffening structure is therefore not achieved through the material thickness here, but through the formation of the side rails by bending, whereby they can also be impressed, in particular, with a predetermined thickness. When metal profiles are used, the side rails can be formed on the profile edges as standing seams in the simplest case. A higher degree of stability is achieved by double standing seams, i.e. by two 90° bends in the same orientation following each other at short distances in the transverse direction of the profile—with bending edges along the longitudinal direction of the side rails. The side rails can also be formed as foldovers, i.e. 180° bends. To further increase the stability it can be advantageous to combine standing seams and foldovers with each other. Between the rungs, the openings are made; this can be effected for example by punching, cutting or milling out. The rungs are preferably formed plate-shaped; i.e. in the longitudinal direction of the side rails, they have a predetermined height which almost reaches the dimensions of the feet in the longitudinal direction of the side rails. In the case of tapering feet, the shape of the plate forming the rung can also be correspondingly adapted, for example into a trapezium shape.

It goes without saying that the above-named features, and those still to be explained below, can be used not only in the stated combinations, but also in other combinations or alone, without departing from the scope of the present invention.

BRIEF DESCRIPTION OF THE DRAWINGS

The invention is explained in more detail below, for example with reference to the attached drawings which also disclose features essential to the invention, in which.

DETAILED DESCRIPTION OF THE DRAWINGS

Figure 1:
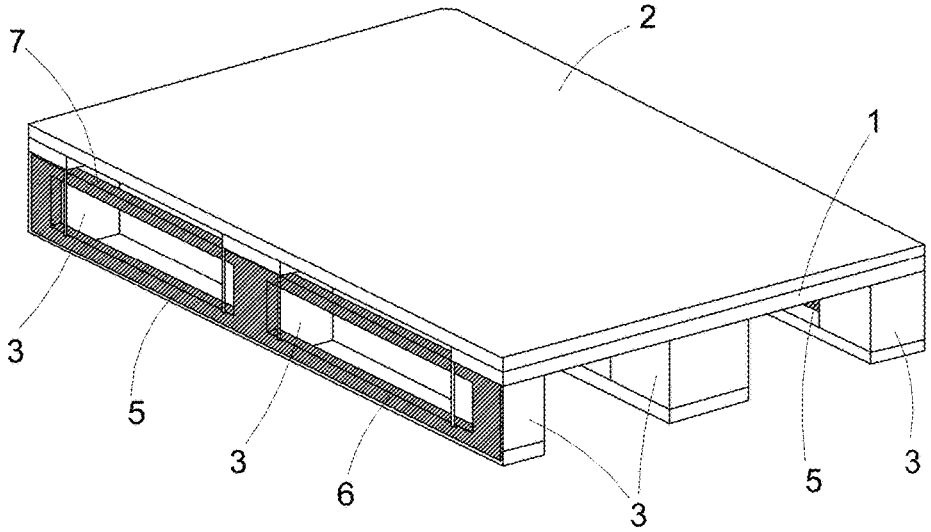
FIG. 1 is a perspective view of a plastic pallet with a ladder-like stiffening structure embedded therein, according to an embodiment.

FIG. 1 shows a conventional plastic pallet which comprises a deck 1 for storing objects to be transported. In the perspective view shown here, a deck upper side 2 can be seen, opposite which there is a deck underside, not shown; deck upper side 2 and deck underside are spaced apart from each other by the thickness of the deck. Feet 3 are formed protruding downwards from the deck underside. In addition, the plastic pallet also comprises runners 4 which are formed in each case connecting at least two feet 3 to each other on their undersides. The front segment of the plastic pallet—comprising three feet and the runners which connect the feet—is here shown cut open with the result that a stiffening structure 5 arranged there—marked by hatching—is visible. The stiffening structure 5, of which the pallet here comprises two in the outer runners, is here formed ladder-like and comprises lower side rails 6 arranged in the runners 4 and upper side rails 7 arranged spaced apart therefrom, which are arranged above the lower side rails 6 running parallel thereto. The upper side rails can be arranged in an area between the deck upper side 2 and the deck underside in the deck 1; but they can also be arranged below the deck 1 as shown for example in FIG. 1. In an arrangement of the upper side rails 7 in the area between the deck upper side 2 and the deck underside, the stiffening structure 5 can then be completely enclosed by the plastic of the pallet in the case of a one-piece manufacture.

The stiffening structure 5 is formed ladder-like and therefore comprises rungs 8 which connect the lower side rails 6 in the feet 3 to the upper side rails 7. The surface of the rungs is predominantly closed, i.e. it comprises no openings or recesses and if it does, then the surface of the openings or recesses is less than 50%, as a rule less than 10%, as a proportion of the entire surface of the rungs 8. Recesses and openings are made only where this is necessary or appropriate for reasons of manufacturing technology.

The rungs 8 are formed either in one piece on the lower side rails 6 or the upper side rails 7, or they are connected thereto, in each case in bonded manner via contact surfaces. Depending on the embodiment, some of the rungs 8 can also be formed in one piece on one or both side rails and other rungs can be connected to the side rails 6, 7 in bonded manner. The type of adhesive bond is selected depending on the material. In the case of metal stiffening structures 5, welding in particular is a possibility here. Depending on the material—for example carbon-fiber- and glass-fiber-reinforced plastics can also be used for the stiffening structure—other types of connection can also prove appropriate, for example friction- or form-locking connections, wherein all types of form locking can also be combined with each other.

Through the one-piece formation of the rungs 8 on the side rails 6 and 7, or through the bonded connection via larger contact surfaces on the one hand and through the predominantly closed surface of the rungs 8 on the other hand, the bending stiffness of the plastic pallet and in particular the shear strength of the plastic pallet in a plane parallel to the deck upper side 2 are increased.

Through the use of stiffening structures 5 formed in such a way, it is possible to reduce the deflection of the plastic pallet when supporting a load in the middle, for example from 22 mm to less than 10 mm in the case of a plastic pallet with the dimensions 1200 mm×800 mm and with 3 feet connected to runners. The shear stiffness is increased as shear forces are diverted via or absorbed by the stiffening structures 5 which can in particular be made of metal.

Figure 2:
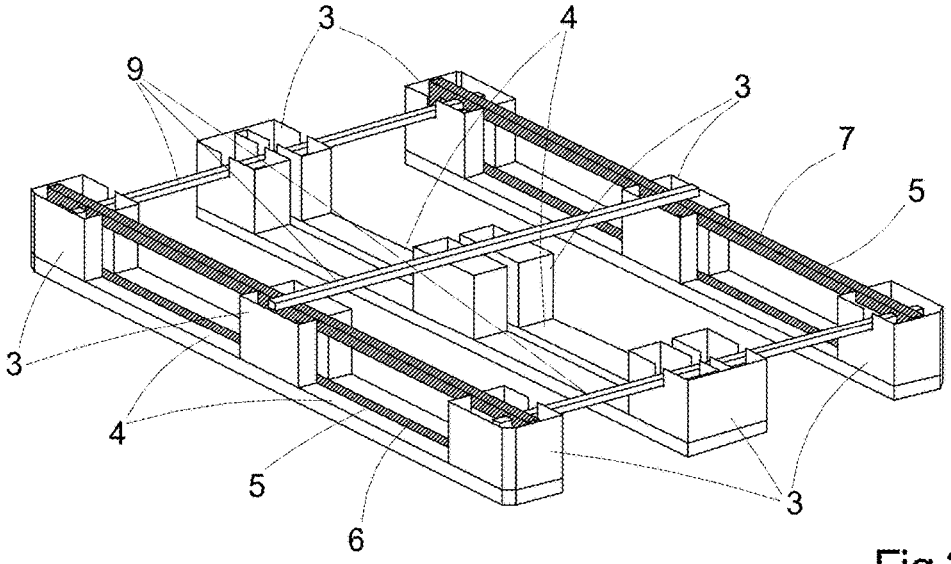
FIG. 2 is a perspective view of a plastic pallet without a deck with stiffening structures.

FIG. 2 shows a plastic pallet without a deck; here only the feet 3 with runners 4 formed thereon are shown. Stiffening structures 5 are inserted in the two outer foot-runner elements. In addition, cross braces 9 are also shown here, which further increase the stability of the plastic pallet. These cross braces 9 can also be made of metal. However, they are purely optional and not strictly necessary for achieving the desired effect. In the interests of the lowest possible mass of the plastic pallet, the cross braces 9 can be dispensed with. They can be inlaid in the pallet independently of the stiffening structures 5, but also connected in bonded, form-locking and/or friction-locking manner thereto, in order to form an even more stable structure. In the present case the two outer cross braces 9 are pushed through openings in the stiffening structures 5 or in the rungs 8 and form a grid therewith. The middle cross brace 9 is only laid on, but could also be integrated into the grid.

Using the stiffening structures 5 it is possible to reduce the deflection to the degree that is considered permissible in the case of wooden pallets of a comparable size, or to an even lower degree. The thicker the stiffening structures—by thickness is meant the extent perpendicular to the longitudinal direction of the side rails and perpendicular to the longitudinal direction of the rungs—the higher the shear and bending stiffness, which is however associated with a higher mass. Although plastic pallets are per se lighter than wooden pallets of the same size, in the case of correspondingly thick stiffening structures 5 the weight of comparable wooden pallets can be exceeded, thereby losing a substantial advantage of plastic pallets.

However, if on the other hand the thickness of the lower side rails 6, the upper side rails 7 and the rungs 8 is selected too small, for example as pure sheet with a constant thickness, in the case of too small a thickness, the necessary shear stiffness cannot be realized. For this reason, at least the upper side rails 7 and the lower side rails 6 have a predetermined thickness.

In the case of a bonded connection of the rungs 8 to the side rails 6, 7 via contact surfaces, and also in the case of a friction- or form-locking connection, the size of the contact surfaces is selected or predetermined depending on a predetermined maximum bending and shear load of the plastic pallet; as a rule the contact surfaces should be selected as large as structurally possible.

In the longitudinal direction of the side rails 6, 7 the rungs 8 have a predetermined height for increasing the shear stiffness and bending stiffness in the longitudinal direction of the side rails 6, 7, which is based on the width of the feet; it should be at least 80% of the width of the respective foot receiving the rung. Here the term "height" is used on the basis of a standing ladder, for a lying structure it corresponds to the width. In the case of a connection of the rungs 8 to the side rails 6, 7 via contact surfaces, the extent of the contact surfaces in the longitudinal direction of the side rails 6, 7 preferably corresponds to the predetermined height.

For the embodiment of the side rails 6 and 7, many design variants are possible, for example the lower side rail 6 and/or the upper side rail 7 can be assembled as hollow structures from various surfaces, for example they can be formed as tubes with the cross-section of a quadrilateral, in particular a trapezium, rectangle or square, which facilitates the connection of the contact surfaces; but an embodiment as a T-beam or as a double T-beam is also conceivable. At least one of the surfaces in each case of one side rail (6, 7) is then preferably aligned perpendicular to the longitudinal direction of the respective side rail 6, 7 and perpendicular to the longitudinal direction of the rungs 8. Contact surfaces can then be formed on these surfaces, in particular for the adhesive bond.

In the case of a bonded connection of the rungs 8 to the side rails 6, 7, the contact surface therefore preferably lies in a plane perpendicular to the longitudinal direction of the rungs 8 and the side rails 6, 7. The extent of the contact surface in the direction of the thickness should then as a rule be more than half the thickness. Depending on the embodiment, the rungs 8 can also have a smaller thickness, in the case of formation from a sheet, for example, a thickness corresponding to the sheet thickness.

Various embodiments of stiffening structures 5 are explained below with reference to FIGS. 3-11.

Figure 3A:
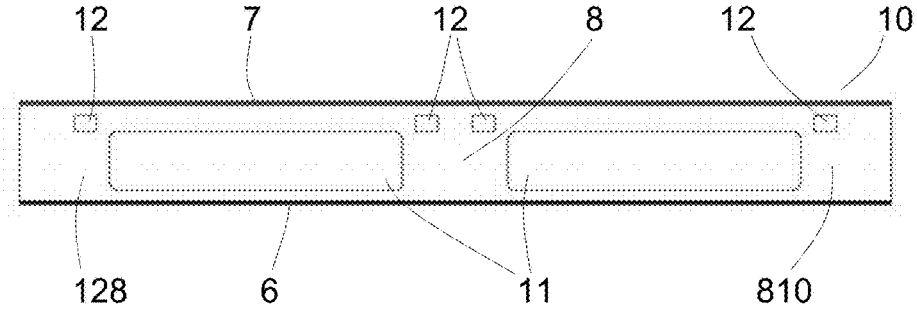
FIGS. 3A-C depict a first embodiment of a stiffening structure.
Figure 3B:
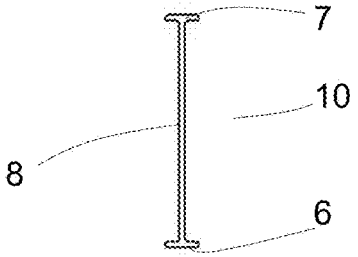
Figure 3C:
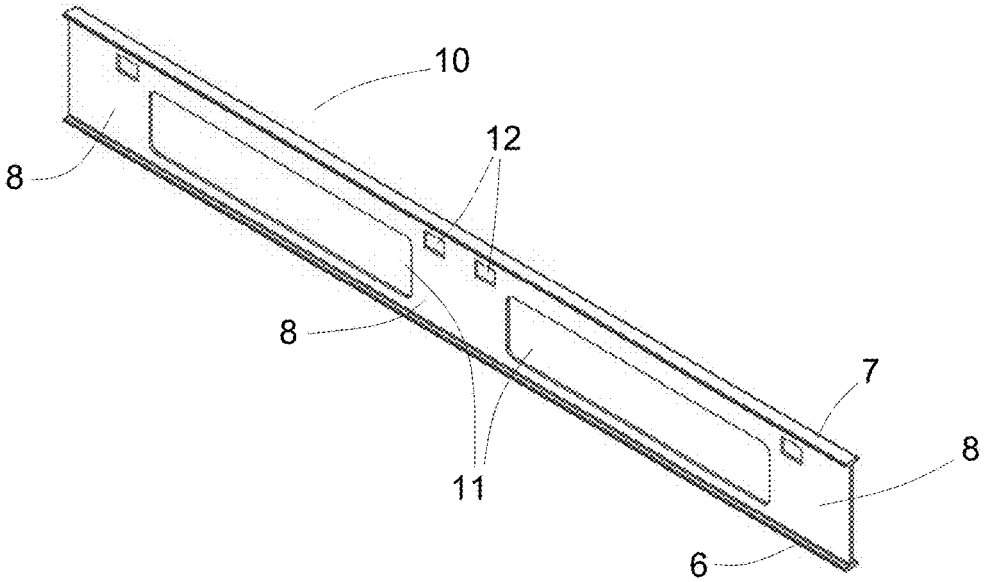

FIGS. 3A-C show a first embodiment of a stiffening structure, as this can be used to increase the bending stiffness and the shear strength of the plastic pallet. FIG. 3A shows a view of the stiffening structure from the front, FIG. 3B a cross-section through the stiffening structure in the area of a rung 8 and FIG. 3C a perspective view of the stiffening structure, which here is formed as an extruded aluminium profile 10. The lower side rail 6 and the upper side rail 7 are in each case formed as a T-beam; the thickness of the side rails 6, 7 can for example be 20 mm in the area of the crossbeam of the "T". As aluminium is a corrosion-resistant material, separate protection against corrosion can be dispensed with. Between the rungs 8, openings 11 are made, which in the assembled state are situated between the feet of the plastic pallet and allow the entry of the fork of a forklift truck. The rungs 8 are here formed in one piece on the side rails 6, 7 and plate-shaped. In the area below the upper side rail 7, through-holes 12 are optionally arranged, through which, during manufacture in the case of a one-piece pallet, plastic can pass, in order to ensure a firm connection between the stiffening structure and the plastic pallet. The through-holes 12 can also be used for another type of attachment, for example a mechanical one, should clamping into the framework structure of the plastic pallet not be possible; in this case no through-holes 12 are required. In particular, the through-holes 12 are however also suitable for receiving optional cross braces 9, in order to fix these better and produce a stiffening grid structure in the plane of the deck 1, as shown in FIG. 2. An advantage of using an extruded aluminium profile is also the reduced mass. Whereas a wooden pallet with the dimensions 800 mm×1200 mm weighs 20-25 kg, the mass of a pallet with the profiles shown in FIGS. 3A-C is approximately 15-20 kg.

Figure 4A:
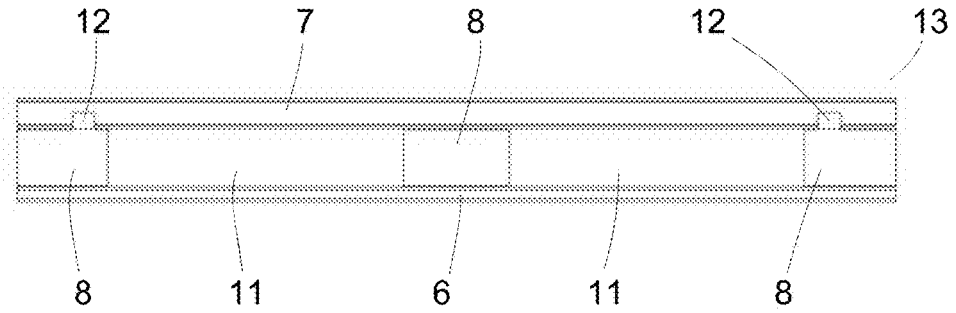
FIGS. 4A-C depict a second embodiment of a stiffening structure.
Figure 4B:
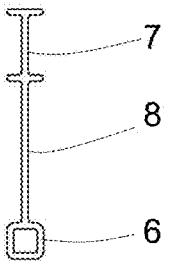
Figure 4C:
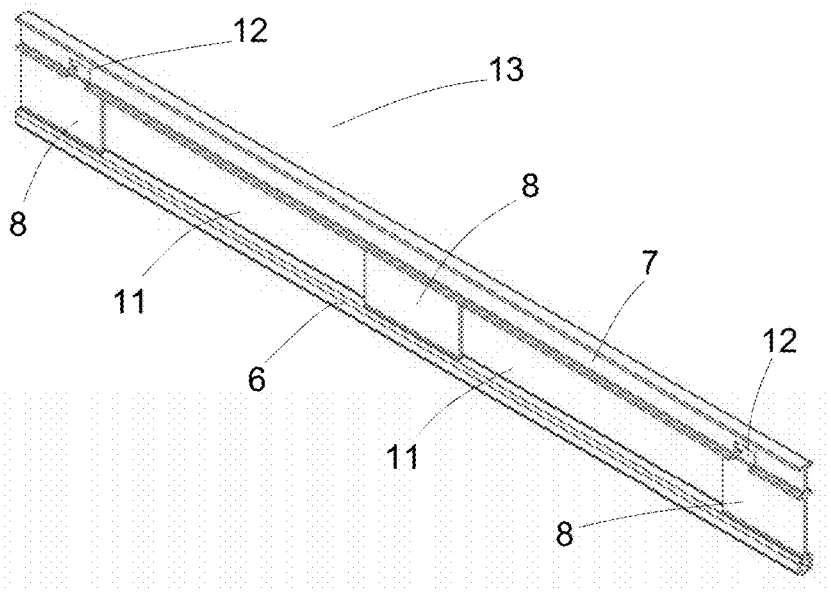

FIGS. 4A-C show a second embodiment of a stiffening structure, which here is formed as a further extruded aluminium profile 13. FIG. 4A shows a view of the extruded aluminium profile 13 from the side, FIG. 4B a cross-section through the profile in the area of a rung 8 and FIG. 4C a perspective view of the extruded aluminium profile 13. Here too, openings 11 are made between the rungs 8. This can be effected for example by punching, cutting or milling. The further extruded aluminium profile 13 shown in FIG. 4 also comprises through-holes 12. However, unlike the extruded profile shown in FIG. 3, here the lower side rail 6 is formed as a tube with a square cross-section and the upper side rail as a double T-beam. Here too, it is of course possible to design one of the side rails as a T-beam, likewise one of the side rails of the extruded aluminium profile 10, which is shown in FIGS. 3A-C, can be designed as a double T-beam or as a tube with a square or rectangular cross-section.

Figure 5A:
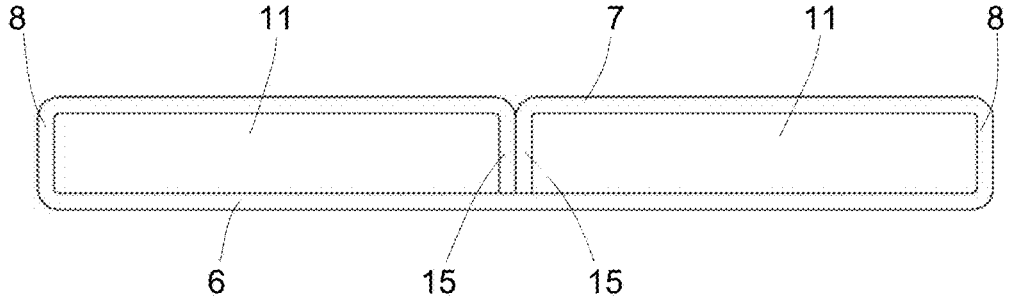
FIGS. 5A-B depict a third embodiment of a stiffening structure.
Figure 5B:
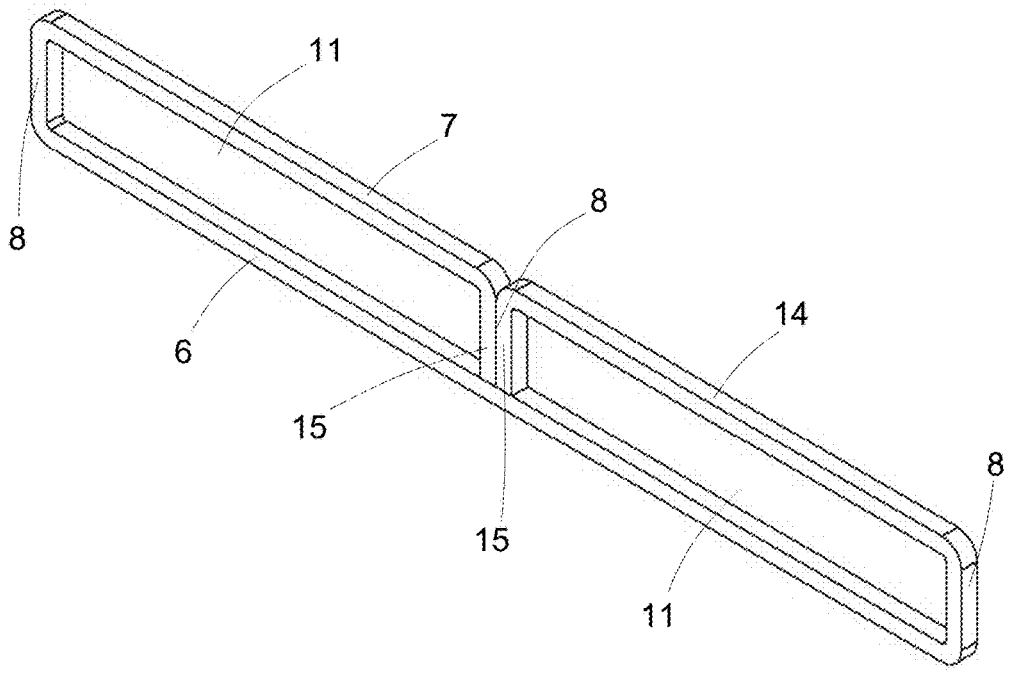

A third embodiment is shown in FIGS. 5A-B. This is a stiffening structure which is formed as a tube with a square cross-section 14. The tube 14 is bent into the shape of two side rails 6, 7, with rungs 8 lying in between. This is a one-piece design with a maximum of three rungs 8 which is suitable for smaller pallets in particular. All the rungs 8 are formed from the square tube 14. In the example shown in FIG. 5, the outer rungs 8 of the stiffening structure are formed by bending the tube 14 twice, in each case by 90°. By contrast, the middle or inner rung 8 is formed in that the two tube ends 15 of one of the side rails—here without limiting the generality, the upper side rail 7, are bent 90°; the middle rung 8 is therefore formed through the bending. The tube ends 15 are connected to the opposite side rail—here the lower side rail 6—in bonded manner, for example by welding, here over the entire thickness of the lower side rail 6. To increase the bending and shear stiffness and the stability of the stiffening structure, the tube ends 15 can also be connected to each other in bonded manner; however, in the case of a corresponding fixing in the middle foot in the plastic pallet, this can also be dispensed with.

Figure 6:
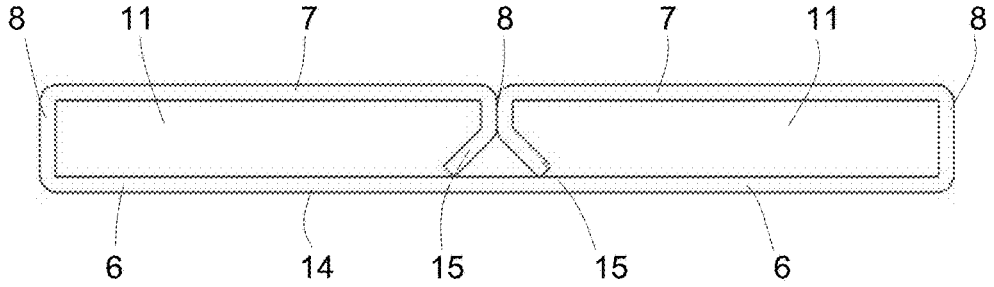
FIG. 6 depicts a modification of the stiffening structure shown in FIG. 5.

A modification of this embodiment is shown in FIG. 6. The tube ends 15 which form the middle rung 8 are here spread apart from each other in their end areas, with the result that the middle rung 8 takes on the shape of a "Y". With one edge, the tube ends 15 are in each case connected in bonded manner to the opposite side rail, here the lower side rail 6, over the entire thickness of the side rail. The edges in question are preferably provided with larger chamfers in order to provide a contact surface for the bonded connection, which is more stable than a linear, one-dimensional connection. Here too, the rungs 8 are formed in one piece on the lower side rail 6 or on the upper side rail 7, even if, to increase the stiffness, the tube ends are connected in bonded manner to the opposite side rail. Through the spreading of the tube ends 15 into the shape of a "Y", the shear stiffness in a plane parallel to the deck 1, or the bending stiffness perpendicular to the deck plane is further increased compared with the design shown in FIGS. 5A-B.

Figure 7A:
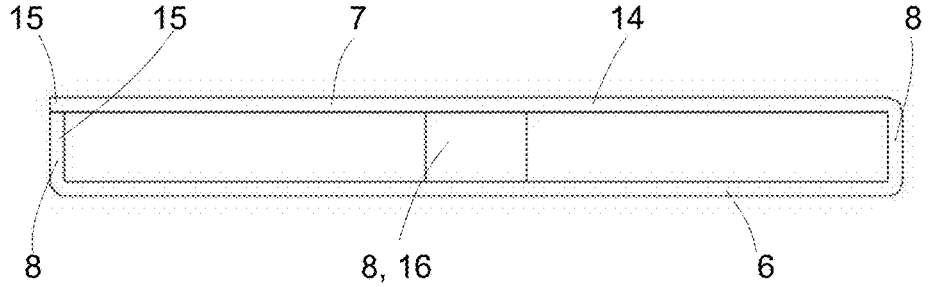
FIGS. 7A-B depict a fourth embodiment of a stiffening structure.
Figure 7B:
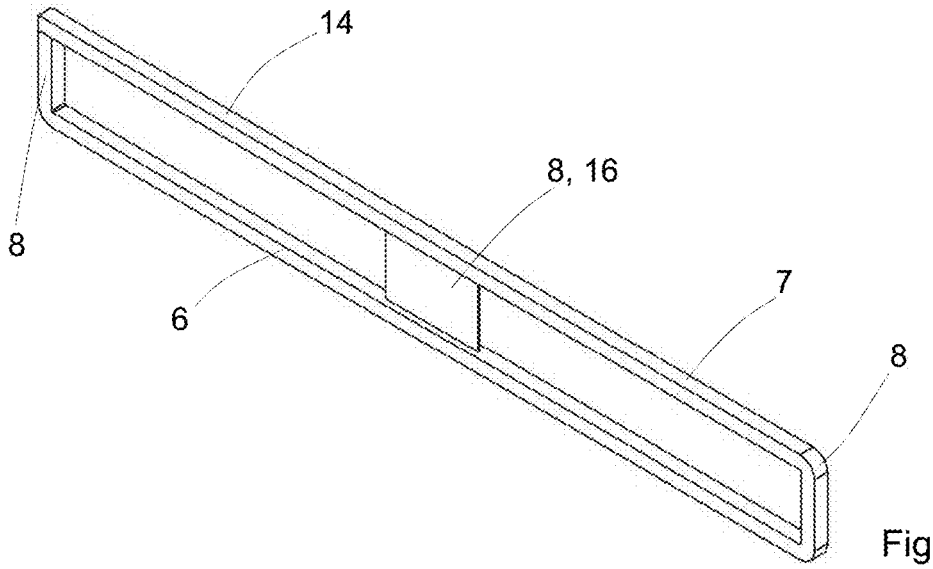

A further design for a stiffening structure is shown in FIG. 7. FIG. 7A shows a projection view of the stiffening structure from the front, and FIG. 7B a perspective view. In this fourth embodiment the side rails are also formed as tubes with a square cross-section; the lower side rail 6 and the upper side rail 7 as well as the two outer rungs 8 are here likewise formed in one piece from a bent tube 14. The two tube ends 15 are connected to each other in bonded manner in the area of one of the outer rungs 8. The tube ends 15 can however also come together at another point of one of the side rails, for example in the area of the middle rung 8. The middle rung 8 is here formed as a plate-shaped connection element 16, in which on two opposite sides, namely the sides facing the side rails 6 and 7, contact surfaces are formed as standing seams. The plate-shaped connection element 16 is here placed centrally—with respect to the thickness of the lower side rail 6 and the upper side rail 7. The extent of the contact surfaces formed by the standing seams in the direction of the thickness is half the thickness here.

This fourth embodiment of a stiffening structure has a particularly good cost-benefit ratio, for one thing as the square tube 14 has to be cut to length only once and bent only four times. However, due to the plate-shaped connection element which can have a C- or S-shape in cross-section, the shear strength and bending stiffness are further increased compared with the designs shown in FIG. 5 and FIG. 6, as the plate-shaped connection element 16 can have the maximum height in the longitudinal direction of the side rails—corresponding to the width in the view—which just makes it possible to completely integrate it into the corresponding foot 3, whereas, in the case of the formation of the middle rung 8 from the bent tube ends 15, the width is predetermined by the thickness of the square tube 14 and cannot be increased. In addition, the stiffening structure shown in FIGS. 7A-B can also be used for pallets with more feet in one direction, as several of the plate-shaped connection elements 16 can readily be placed as inner rungs between the outer rungs formed in one piece.

Figure 8A:
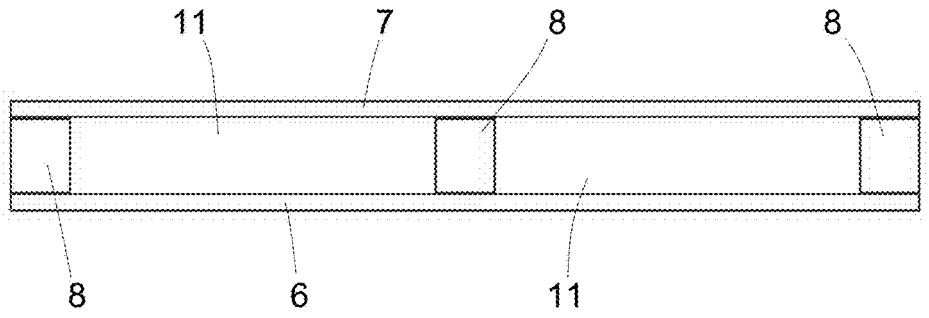
FIGS. 8A-C depict a fifth embodiment of a stiffening structure.
Figure 8B:
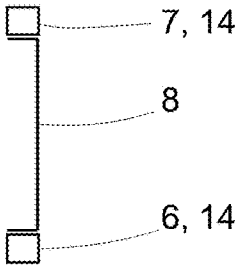
Figure 8C:
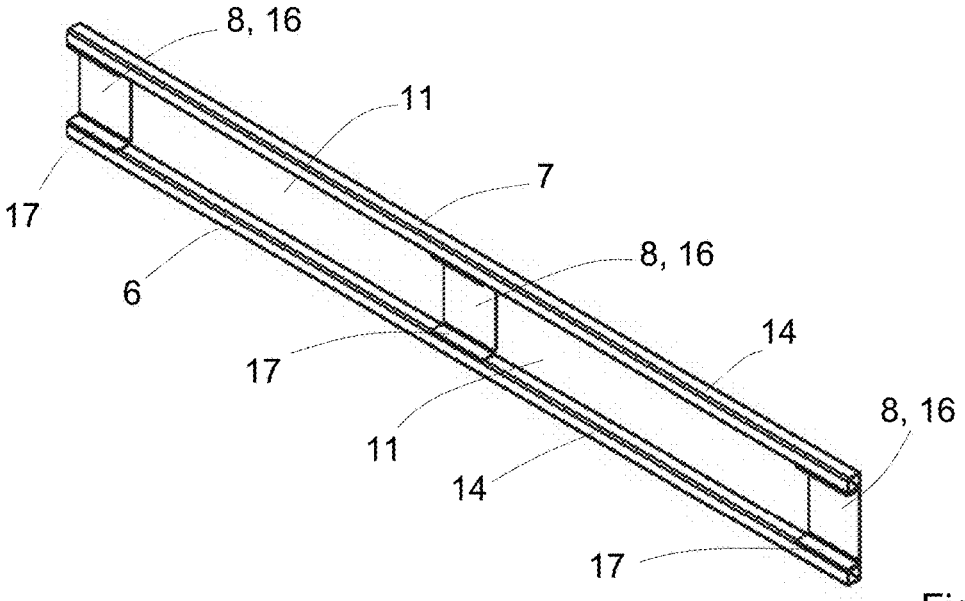

A further—particularly stable—fifth embodiment of a stiffening structure for a plastic pallet is shown in FIG. 8. FIG. 8A shows a side view of a stiffening structure lying on the outer edge of a side rail, FIG. 8B the cross-section in the area of a rung 8 and FIG. 8C a perspective view. Unlike the embodiment shown in FIG. 7, here too the outer rungs 8 are formed as plate-shaped connection elements 16 with standing seams 17 formed thereon for forming the contact surfaces. The plate-shaped connection elements 16 have a "C"-shape in cross-section—as shown in FIG. 8C. In this design, the lower side rail 6 and the upper side rail 7 are also formed as a tube 14 with a square cross-section. They can be produced from a tube by sawing. In each case three plate-shaped connection elements 16—here of the same kind—connect the upper side rail 7 to the lower side rail 6; the standing seams 17, which are formed on the plate-shaped elements 16 by bending, form the contact surfaces. Their extent in the direction of the thickness of the side rails 6, 7 here corresponds to the entire thickness of the side rails 6 and 7. By means of the contact surfaces, the plate-shaped connection elements are connected to the side rails 6 and 7 in bonded manner. After production of the bonded connection, the stiffening structure still has to be galvanized for protection against corrosion.

Although the designs described in FIGS. 5-8 are more expensive to produce compared with the above-described variants made of extruded aluminium profile, they are more sparing with material resources as practically no waste is produced, whereas when the opening 11 is made in the extruded aluminium profiles 10 and 13 described in connection with FIG. 3 and FIG. 4, a substantial proportion of material waste is produced.

Figure 9A:
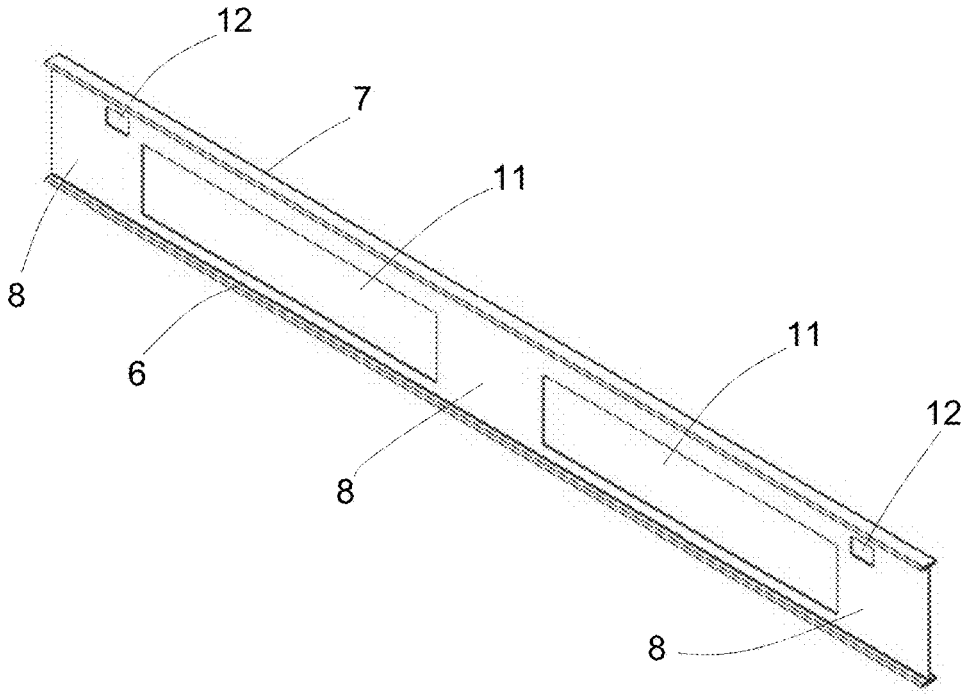
FIGS. 9A-B depict a sixth embodiment of a stiffening structure.
Figure 9B:
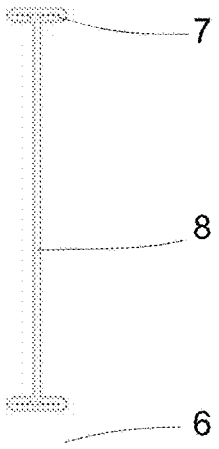

FIGS. 9-11 show further embodiments for stiffening structures which are all formed in one piece from rolled and bent metal profile, for example (steel) sheet or strip steel, wherein openings 11 are again made between the rungs 8. In addition, these stiffening structures also comprise optional through-holes 12. The embodiments differ here only in the formation of the lower side rail 6 and of the upper side rail 7, which are formed on the profile edges by bending, and are formed as standing seams, double standing seams, foldovers or combinations thereof. The metal profile shown in perspective view in FIG. 9A and in cross-section in FIG. 9B in the area of a rung 8 as sixth embodiment of a stiffening structure comprises an upper side rail 7 formed identically to the lower side rail 6. The side rails are formed by a 90° standing seam and two foldovers, i.e. 180° bends, in the opposite orientation. The bends are arranged mirror-symmetrically with respect to a horizontal plane in the sheet, with the result that the profile with the two standing seams forms a "C"-shape which offers a somewhat higher degree of stability compared with an "S"-shape which is also possible. All the rungs 8 are formed plate-shaped and in one piece on the side rails 6 and 7.

Figure 10A:
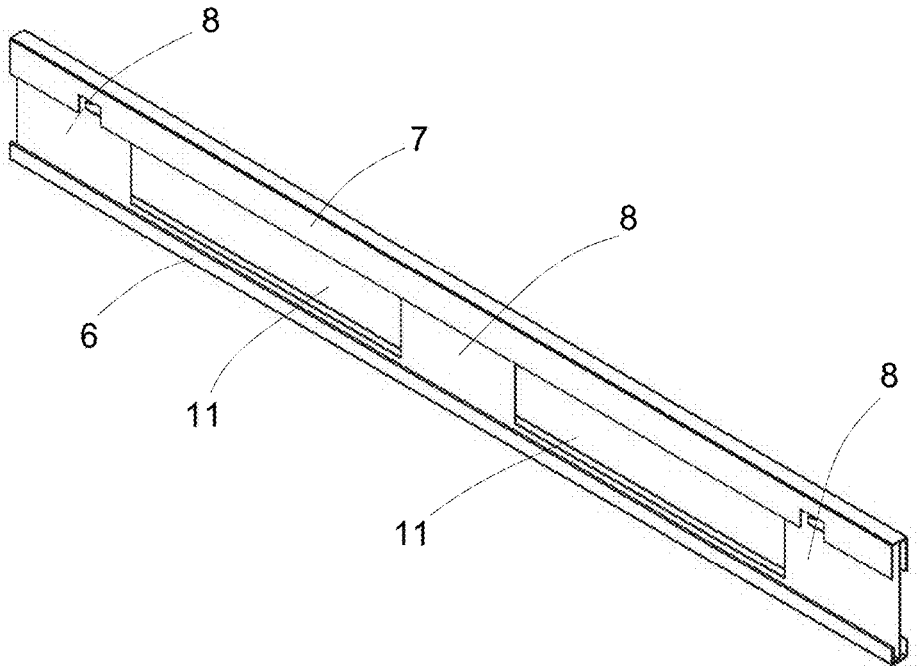
FIGS. 10A-B depict a seventh embodiment of a stiffening structure.
Figure 10B:
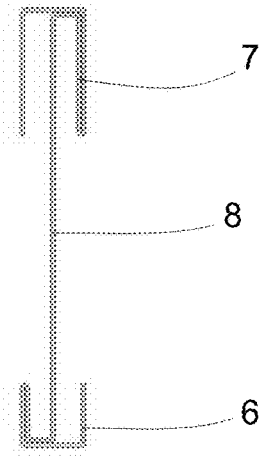

The metal profile shown in perspective in FIG. 10A and in cross-section in FIG. 10B in the area of a rung 8 as seventh embodiment of a stiffening structure comprises side rails 6, 7 formed by other bend combinations. The plate-shaped rungs 8 are here also formed in one piece on the side rails 6, 7, and arranged centrally with respect to the thickness of the side rails 6 and 7—in FIG. 10B corresponding to the horizontal direction in the sheet plane. However, the upper side rail 7 has a greater width—corresponding to the vertical direction in the sheet plane—than the lower side rail 6. Here the fact can be utilized that on the one hand the runners 4 should be kept flat, however on the other hand for the upper side rail 7—in the case of complete enclosure by the plastic—almost the entire deck height can be used. This additionally increases the stability. The side rails 6, 7 are here formed by the combination of several 90° bends (standing seams) and one 180° bend (foldover).

Figure 11A:
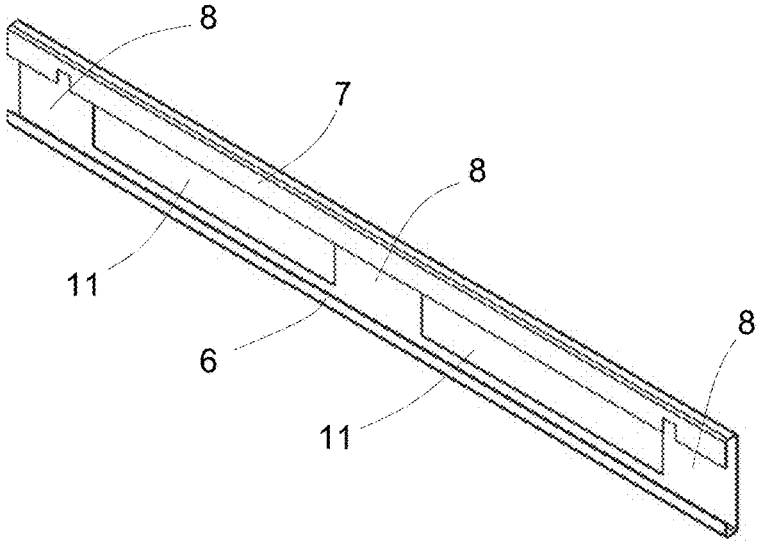
FIGS. 11A-C depict an eighth embodiment of a stiffening structure.
Figure 11B:
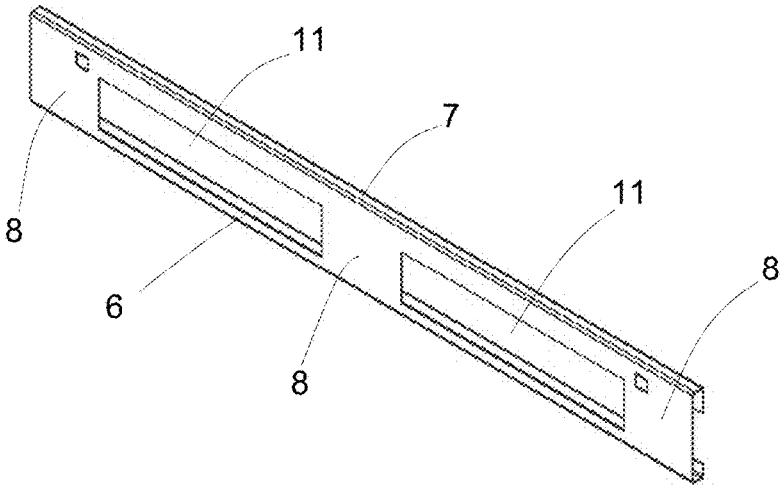
Figure 11C:
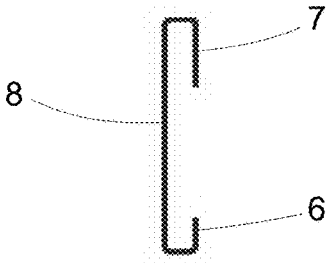

An eighth design of a stiffening structure is finally shown in FIG. 11. FIG. 11A and FIG. 11B show the stiffening structure formed as a metal profile in perspective, from two opposite sides, FIG. 11C shows the profile in cross-section in the area of a rung 8. Here too, the upper side rail 7 is designed wider than the lower side rail 6. Both side rails 6, 7 are formed as double standing seams. For each side rail, only two bends are required here; the stiffening structure is thus comparatively simple to produce, but also offers a very high bending and shear strength.

All the profiles are characterized by the fact that, with relatively low mass, they are capable of giving a plastic pallet the required bending and shear stiffness, with the result that the deflection in the middle is no greater than in the case of wooden pallets; on the other hand however, the mass of the plastic pallet with stiffening structures is even lower than in the case of conventional wooden pallets of the same size. Whereas the latter, with dimensions of 1200×800 mm, have a weight of 20-25 kg, it is possible with the invention presented here, to keep the weight of the plastic pallets significantly below this, at approximately 15-20 kg.

LIST OF REFERENCE NUMBERS

1 deck
2 deck upper side
3 foot
4 runner
5 stiffening structure
6 lower side rail
7 upper side rail
8 rung
9 cross brace
10 extruded aluminium profile
11 opening
12 through-hole
13 extruded aluminium profile
14 tube with square cross-section
15 tube end
16 plate-shaped connection element
17 standing seam

The invention claimed is:

1. A plastic pallet, comprising:

a deck for storing objects to be transported, feet which are formed protruding from a deck underside, and runners which are formed in each case connecting at least two feet to each other on undersides of the feet, at least one stiffening structure, comprising lower side rails arranged in the runners and upper side rails arranged spaced apart therefrom, which are arranged above the lower side rails running parallel thereto wherein the at least one stiffening structure comprises rungs, each rung having a predominantly closed surface, the predominantly closed surface having no openings, or having one or more openings with a combined opening area that is less than 50% of the predominantly closed surface, the rungs connecting the lower side rails to the upper side rails, wherein the rungs are formed integrally with the side rails or are connected thereto via contact surfaces in a bonded, friction-locking or form-locking manner, whereby a bending stiffness of the pallet and a shear strength of the pallet in a plane parallel to the deck upper side are increased.

2. The plastic pallet according to claim 1, wherein the side rails have a predetermined thickness.

3. The plastic pallet according to claim 1, wherein the rungs are connected to the side rails via contact surfaces, and a size of the contact surfaces is predetermined depending on a predetermined maximum bending and shear load of the plastic pallet.

4. The plastic pallet according to claim 3, wherein the side rails are formed as hollow structures assembled from various surfaces, as tubes with the cross-section of a rectangle, or as T-beams or double T-beams, wherein in each case at least one of the surfaces of a side rail is aligned perpendicular to a longitudinal direction of the side rails and the rungs.

5. The plastic pallet according to claim 4, wherein in the case of a bonded connection of the rungs to the side rails, the contact surfaces lie in a plane perpendicular to the longitudinal direction of the side rails and rungs and an extent of the contact surfaces in a direction of the thickness of the side rails is at least one-quarter of the thickness.

6. The plastic pallet according to claim 4, wherein in the case of a bonded connection of the rungs to the side rails, the contact surfaces lie in a plane perpendicular to the longitudinal direction of the side rails and rungs and an extent of the contact surfaces in a direction of the thickness of the side rails is at least one-half of the thickness.

7. The plastic pallet according to claim 4, wherein in the case of a bonded connection of the rungs to the side rails, the contact surfaces lie in a plane perpendicular to the longitudinal direction of the side rails and rungs and an extent of the contact surfaces in a direction of the thickness of the side rails corresponds to a total thickness of the rungs.

8. The plastic pallet according to claim 1, wherein the rungs have a predetermined height in the longitudinal direction of the side rails, which corresponds to at least 80% of a width of a respective foot receiving the rung, wherein, in the case of a bonded, friction-locking or form-locking connection, the extent of the contact surfaces in the longitudinal direction of the side rails corresponds to the predetermined height.

9. The plastic pallet according to claim 1, wherein the rungs are integrally formed with the side rails, and wherein the at least one stiffening structure is formed as an extruded aluminium profile with openings made between the rungs.

10. The plastic pallet according to claim 1, wherein at least one lower side rail, one upper side rail and two outer rungs are formed in one piece from a bent tube with a square cross-section.

11. The plastic pallet according to claim 10 with three rungs formed integrally with the side rails, wherein the tube is bent into a shape of two side rails with rungs lying in between and wherein two tube ends are bent from one of the side rails to the other, opposite side rail and form a middle rung, and are connected to each other and to the other, opposite side rail in a bonded manner over an entire thickness of the opposite side rail.

12. The plastic pallet according to claim 1, wherein the rungs are connected to the side rails via contact surfaces and the lower side rails and the upper side rails are formed as tubes with a square cross-section and at least inner rungs are formed as plate-shaped connection elements, and the contact surfaces are formed as standing seams on two opposite sides.

13. The plastic pallet according to claim 1 wherein the rungs are formed integrally with the side rails, wherein the at least one stiffening structure is formed as a rolled and bent metal profile with openings made between the rungs and wherein the side rails are formed on the profile edges as standing seams, double standing seams, foldovers or combinations thereof.

14. The plastic pallet according to claim 13, wherein the rungs are formed as plate-shaped rungs.

15. The plastic pallet according to claim 1, wherein the rungs are formed as plate-shaped rungs.

* * * * *